US011377617B2

(12) United States Patent
Carli et al.

(10) Patent No.: US 11,377,617 B2
(45) Date of Patent: Jul. 5, 2022

(54) STABILIZED LUBRICANT COMPOSITION FOR CONTINUOUS CASTING PROCESSES

(71) Applicant: PROSIMET S.P.A., Filago (IT)

(72) Inventors: Riccardo Carli, Filago (IT); Marco Alloni, Filago (IT); Simone Casagrande, Filago (IT)

(73) Assignee: PROSIMET S.P.A., Filago (IT)

( * ) Notice: Subject to any disclaimer, the term of this patent is extended or adjusted under 35 U.S.C. 154(b) by 0 days.

(21) Appl. No.: 17/261,637

(22) PCT Filed: Jun. 24, 2019

(86) PCT No.: PCT/IB2019/055291
§ 371 (c)(1),
(2) Date: Jan. 20, 2021

(87) PCT Pub. No.: WO2020/016682
PCT Pub. Date: Jan. 23, 2020

(65) Prior Publication Data

US 2021/0261880 A1 Aug. 26, 2021

(30) Foreign Application Priority Data

Jul. 20, 2018 (IT) ..... 102018000007380

(51) Int. Cl.
*C10M 169/04* (2006.01)
*B22D 11/07* (2006.01)
(Continued)

(52) U.S. Cl.
CPC ..... *C10M 169/04* (2013.01); *B22D 11/07* (2013.01); *C10M 105/38* (2013.01);
(Continued)

(58) Field of Classification Search
CPC ..... C10M 169/04; C10M 105/38; C10M 107/02; C10M 111/04; C10M 125/10;
(Continued)

(56) References Cited

U.S. PATENT DOCUMENTS 2,711,394 A * 6/1955 Veatch ..... C10M 1/08 508/126
3,411,564 A 11/1968 Miller
(Continued)

FOREIGN PATENT DOCUMENTS

| | | |
|---|---|---|
| EP | 2626407 B1 | 8/2013 |
| GB | 1224338 A | 3/1971 |
| JP | H05111739 A | 5/1993 |

OTHER PUBLICATIONS

International Search Report and Written Opinion for corresponding PCT/IB2019/055291 dated Oct. 2, 2019, 9 pages.

*Primary Examiner* — Cephia D Toomer
(74) *Attorney, Agent, or Firm* — Armstrong Teasdale LLP

(57) ABSTRACT

Described herein is a stabilized lubricant composition for use in steel casting, in particular in continuous casting processes. In particular, the lubricant composition for processes for producing steel by continuous casting includes a dispersion of a lubricant powder, for an ingot mold, in continuous casting, in an oily liquid means, and a stabilization additive, characterized in that it has the following shear thinning index values:

| RVT | 0.1/1 | 1/10 | 10/100 | 100/1000 |
|---|---|---|---|---|
| STI | 3.0-7.5 | 2.0-6.5 | 1.0-3.0 | 0.5-2.0 |

(Continued)

wherein RVT is the ratio between two different shear speeds and STI is the shear thinning index corresponding to the RVT values.

15 Claims, 1 Drawing Sheet

(51) Int. Cl.

| | |
|---|---|
| ***C10M 105/38*** | (2006.01) |
| ***C10M 107/02*** | (2006.01) |
| ***C10M 111/04*** | (2006.01) |
| ***C10M 125/10*** | (2006.01) |
| ***C10M 125/18*** | (2006.01) |
| ***C10M 125/26*** | (2006.01) |
| ***C10M 133/06*** | (2006.01) |
| ***C10M 141/06*** | (2006.01) |
| ***C10M 177/00*** | (2006.01) |
| *C10N 40/20* | (2006.01) |
| *C10N 50/00* | (2006.01) |
| *C10N 30/00* | (2006.01) |
| *C10N 20/06* | (2006.01) |
| *C10N 40/24* | (2006.01) |
| *C10N 70/00* | (2006.01) |

(52) U.S. Cl.
CPC ..... *C10M 107/02* (2013.01); *C10M 111/04* (2013.01); *C10M 125/10* (2013.01); *C10M 125/18* (2013.01); *C10M 125/26* (2013.01); *C10M 133/06* (2013.01); *C10M 141/06* (2013.01); *C10M 177/00* (2013.01); *C10M 2201/062* (2013.01); *C10M 2201/081* (2013.01); *C10M 2201/105* (2013.01); *C10M 2205/0206* (2013.01); *C10M 2207/2835* (2013.01); *C10M 2215/26* (2013.01); *C10N 2020/06* (2013.01); *C10N 2030/68* (2020.05); *C10N 2040/24* (2013.01); *C10N 2040/246* (2020.05); *C10N 2050/015* (2020.05); *C10N 2070/00* (2013.01)

(58) Field of Classification Search
CPC ..... C10M 125/18; C10M 125/26; C10M 133/06; C10M 141/06; C10M 177/00; C10M 2201/062; C10M 2201/081; C10M 2201/105; C10M 2205/0206; C10M 2207/2835; C10M 2215/26; B22D 11/07; C10N 2040/246; C10N 2050/015; C10N 2030/68; C10N 2020/06; C10N 2040/24; C10N 2070/00
See application file for complete search history.

(56) References Cited

U.S. PATENT DOCUMENTS 3,574,112 A * 4/1971 Nelson ..... C10M 1/08 508/459
2013/0206353 A1* 8/2013 Carli ..... C10M 141/04 164/472

* cited by examiner

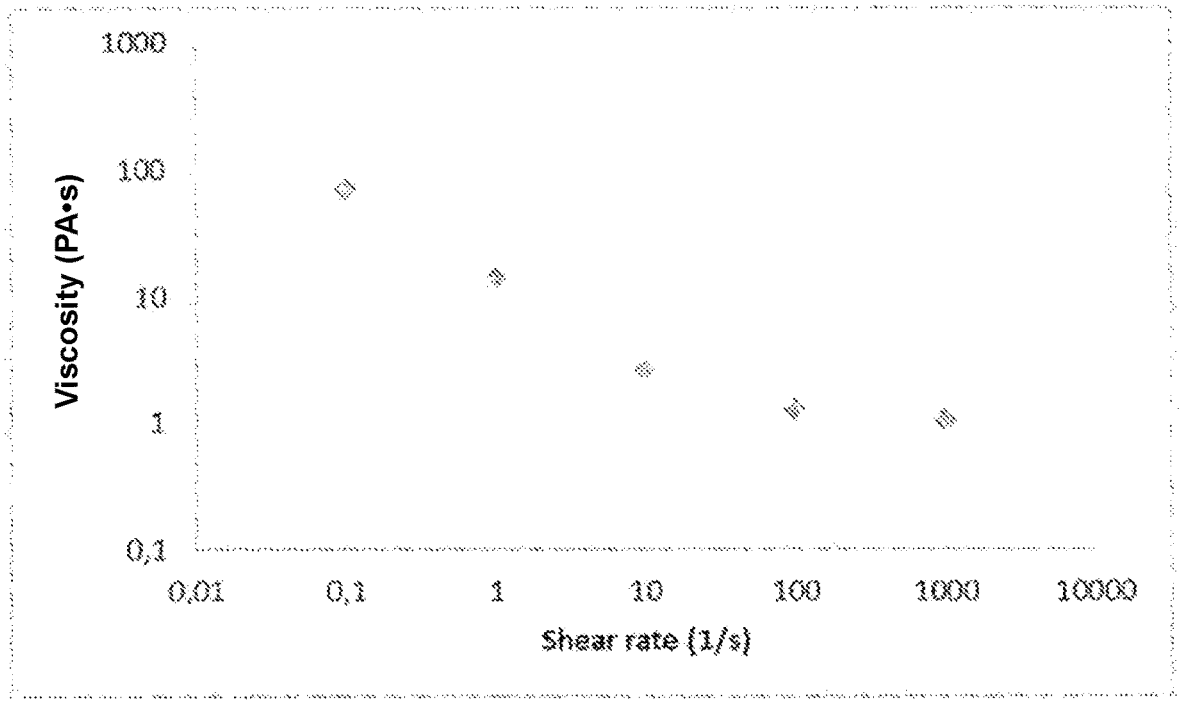
1000
100
10
1
0,1
Viscosity (PA•s)
0,01
0,1
1
10
100
1000
10000
Shear rate (1/s)

STABILIZED LUBRICANT COMPOSITION FOR CONTINUOUS CASTING PROCESSES

CROSS-REFERENCE TO RELATED APPLICATIONS

This application is a National Stage Application of International Patent Application No. PCT/IB2019/055291, having an International Filing Date of Jun. 24, 2019, which claims the benefit of priority to Italian Patent Application No. 102018000007380, filed Jul. 20, 2018, the entire contents of which are hereby incorporated by reference herein.

FIELD OF THE INVENTION

The present invention relates to a stabilized lubricant composition for use in the casting of steel in continuous casting.

STATE OF THE ART

Two main process categories are known in continuous steel casting, that is, protected casting processes ("close casting") and open casting processes ("open casting"). In close casting processes, the use of a particular tube of ceramic material, called a submerged entry nozzle, SEN, for conveying the liquid steel from the tundish to the ingot mold, allows the most modern lubrication systems to be used, consisting of powders for continuous casting. Vice versa, in open casting processes where a saving can indeed be made due to the arrangement of the submerged entry nozzle, lubricant oils of mineral, vegetable or synthetic origin are used. These types of lubricants, however, do not always guarantee effective lubrication. Consequently, there is an excessive formation of flakes, cracks, diamonds and rolling difficulties.

Ingot mold lubricant powders, which, as said, are used in close casting, normally consist of a mixture of various minerals. Depending on the production techniques adopted, such powders are available in various forms, for example, atomized granular powders, extruded powders and powders obtained by fritting. As regards the chemical composition, ingot mold powders consist of a complex mixture of carbon (graphite), various oxides of mineral or synthetic origin (including $SiO_2$, $Al_2O_3$, $Na_2O$, CaO) and other materials.

The lubricant powders mainly serve four functions, after being added to the surface of the cast steel in the ingot mold and they can be summarized thus: i) thermal insulation of the liquid steel in the ingot mold to prevent the solidification thereof; ii) protection of the steel surface from oxidation; iii) lubrication and heat exchange control between the wall of the ingot mold and the solidified steel outer casting; iv) absorption of non-metallic inclusions from the steel. After being poured into the ingot mold, the powders lose part of the carbon by oxidation and are heated in contact with the liquid steel, forming a sintered layer and a molten one. The latter is distributed over the whole of the free surface of the steel and, due to the oscillations of the ingot mold, infiltrates the space between it and the solidified steel outermost casing. In this way, the liquid layer acts as a lubricant. In turn, the infiltrated liquid partially solidifies in contact with the ingot mold, whose wall is generally cooled by water, forming a layer of solid slag. The function of this layer is to allow an adequate level of heat transfer between the solidified steel casing and the ingot mold.

Ingot mold powders allow a better quality of steel to be obtained, but, disadvantageously, they offer poor manageability, which makes them difficult to use in open casting. In particular, the use of a powder for an ingot mold is difficult to realize because of particular feeding systems relating to electromechanical, electronic and automation details.

To overcome this technical problem, European patent EP 2 626 407 B1 by the same Applicant has proposed a liquid composition formed by an oily liquid means comprising a solid lubricant composition. Although such lubricant composition overcomes the problem of manageability, like the known liquid lubricant compositions, but with the further advantage compared to the latter of being far more stable at elevated temperatures of use, it has shown limited intrinsic rheological stability, which is not fully compatible with an industrial use thereof. In fact, it has been observed that on keeping the container in storage for a long period of time, the lubricant powder tends to sediment irreversibly, making the subsequent use of the composition unusable by pumping, also after mixing.

Sedimentation is the phenomenon based on which solid particles suspended in a fluid accumulate due to the relative movement between the two steps. Such movement is generated by a force field, which can generally be gravitational, centrifugal or electrical. Various models exist, which describe the phenomenon with increasing levels of complexity:

- free sedimentation (applied to diluted suspensions, in other words, with a solid volume fraction, $\phi$, <0.02): considers the movement of a single particle as if it was the only one present in the system and the liquid step as if it was unlimited in space. In conditions of laminar movement, it leads to the definition of a limit fall velocity called Stokes velocity;
- mass sedimentation (applied to concentrated suspensions, with $\phi$>0.02): frequent collisions between the particles make the real fall velocity lower than the free fall velocity. On sedimentation, the particles occupy the space previously filled by the fluid, thus generating a flow of the latter upwards, which increases friction on the particle and thus slows down the movement thereof. This model is further complicated when the granulometric dispersion of the solid is also taken into account.

The stabilization of dispersions is described in literature. It is known that a suspension is colloidally stable if the Brownian movement prevails over the gravitational force and that gravitational forces always prevail for particles with dimensions>1 μm.

Various methods are known for preventing sedimentation in aqueous suspensions:

- Balancing the density of the dispersed and dispersant phases, for example, by melting an inert substance in the liquid step, but the parity of the densities is only valid at one temperature value;
- Reducing the dimensions of the particles to an average size<0.1 μm, so that the Brownian diffusion prevails over the gravitational force, preventing sedimentation;
- Increasing the viscosity of the fluid by adding thickeners (especially with high molecular weight);
- Using fine inert particles, for example, of inorganic materials, such as silica, montmorillonite or phosphoric esters crosslinked with metals, dispersed in liquids, forming gel (three-dimensional structures), which stabilize the suspension;
- Combining thickeners and fine particulates;
- Adding an inert polymer (which is not adsorbed). This causes a reversible flocculation, which forms a gel at high suspension concentrations, preventing sedimentation;

Using a crystalline liquid phase, produced by high concentration surfactants, giving rise to highly viscous compositions, demonstrating elastic behavior.

Except for some general indications, these indications describe the possibility of stabilizing dispersions of solids in water or another polar liquid means. Whereas, little is reported in literature about the stabilization of dispersions of solids in organic liquid means.

Furthermore, the inventors of the present invention had to deal with a further technical problem, that is, the fact that a stabilization of the solid-in-oil composition known from EP 2 626 407 B1 requires elevated rheological stability during storage, but pumpability during the use thereof. Stabilization, which increases composition density and viscosity in static conditions, according to the known methods, is too dense and viscous in dynamic conditions and consequently unsuitable for pumping, as required by the lubricant composition of the invention.

SUMMARY OF THE INVENTION

Thus, it is an object of the present invention to provide a lubricant composition for an ingot mold, which can be used both in close and open continuous casting processes, characterized by notable manageability in the process application thereof, so as to be pumpable with the type of dosing pumps normally used, with prolonged shelf-life and rheological stability for storage, guaranteeing an elevated standard of quality of the steel thus produced.

Such object is achieved with a lubricant composition for an ingot mold, as defined in the appended claims, whose definitions form an integral part of the present patent application.

BRIEF DESCRIPTION OF THE FIGURES

FIG. 1 shows a viscosity curve with different shear rate values relating to the stabilized lubricant composition of the invention.

DETAILED DESCRIPTION OF THE INVENTION

A lubricant composition for processes for producing steel by continuous casting forms the object of the present invention, comprising a dispersion of a lubricant powder in a liquid means and a stabilization additive, which is rheologically stable in static conditions and sufficiently fluid for pumping in dynamic conditions.

The lubricant powder can be a powder for an ingot mold normally used in continuous casting processes.

The lubricant powder adapted for the objects of the invention is formulated so as to maximize the speed of the phase transition, having a melting start point of below about 600° C., preferably about 580° C., for obtaining therefrom a melted mixture, producing a good system lubrication action.

The term "melting start point" is understood to mean the lowest temperature at which a first liquid step is formed in the lubricant powder mass, in other words, the temperature at which the solid begins to melt and at which the first liquid drop is formed. This definition can be applied to substance mixtures, which typically melt in a wide range of temperatures.

Such temperature can be measured using various methods, such as those described in C. A. Pinheiro et al., KEEPING CURRENT I, March 1995, pages 76-77. For example, the temperature of the melting start point of the solid lubricant composition of the invention can be determined by means of a high-temperature microscope, the so-called "quench test" or differential thermal analysis (DTA). The differences in measurements using such methods are generally below 5%, therefore the terms "about 600° C." and "about 580° C." for the values reported above of the melting start point shall be understood as "600° C.±30° C." and "580° C.±29° C.".

The lubricant powder comprises carbon in the form of graphite, ground coke or carbon black, $SiO_2$, $Al_2O_3$, $Na_2O$, CaO, fluorides, oxides of transition metals and other oxides and it has the following characteristics:

- Basicity index, $CaO/SiO_2$, comprised within the range 0.25-1.8;
- Content of alkalis, comprised within the range 0.1-15.0% wt.;
- Content of alkaline earth metals, comprised within the range 0.1-45.0% wt.;
- Content of alumina, comprised within the range 0.1-25.0% wt.;
- Content of MnO, $MnO_2$, and $Fe_2O_3$ comprised within the range 0.1-15.0% wt.;
- Content of fluoride, $F^-$, comprised within the range 0.1-14.0% wt.;
- Content of other oxides, such as $TiO_2$, $B_2O_3$, $La_2O_3$, comprised within the range 0.1-15.0% wt;
- Average particle size of the components 0.1-100 μm, measured according to the standard method ASTM D4464-10.

The size of the solid particles is an important characteristic because it defines the maximum packing fraction ($\Phi_m$) and, consequently, the relative viscosity of the dispersion.

The liquid means is an oily liquid means. Lubricant oils normally used in these types of procedures can be adopted. In one embodiment, the oily means prevalently comprises glyceric esters of fatty acids, preferably a glyceric ester of oleic acid, for example, triglyceric ester of the oleic acid, or poly-α-olefins.

The liquid means serves as a carrier for the solid component. In this way, the lubricant component can be loaded using conventional pumping means.

The liquid means has a kinematic viscosity, $\mu_0$ from 25 to 150 $mm^2/s$ at 40° C. (ASTMD445, gravimetric method with capillary viscometer) and a pour point≤−20° C., measured according to the standard method ASTM D-97. The latter characteristic allows the formation of sludge to be avoided at low temperatures.

The stabilization additive is preferably selected from:

Organic additives:

secondary or tertiary amines with c4-c18 chains;

amides or imides with c4-c18 chains;

esters of mono- or di-carboxylic acids with c4-c18 chains with alcohols or polyols with c4-c18 chains;

mono-o poly-carboxylic acids with c4-c18 chains;

Salts of one or more of the aforesaid compounds.

amino acids and peptides up to 10 amino acidic units

Inorganic additives:

oxides or hydroxides of transition metals, carbonates or hydrogen carbonates of alkaline or alkaline earth metals, silica, alumina, silicates, aluminosilicates, fluoro silicates, phosphosilicates, carbon allotropes.

The inorganic additives used have a granulometry within the range of 1 nm-100 microns.

In preferred embodiments, the stabilization additives of the invention are used in a concentration from 0.05% to 10% in mass with respect to the oil mass.

Examples of stabilization additives include the following (in brackets the preferably usable quantities, in mass with respect to the oil mass, of the specific additive):

preferably usable in mineral oil (Rumanol)
- Lubrizol (0.1-1%)
- Succinimide (0.5-5%)
- Starch (0.5-1%)
- Coke (0.5-1%)
- P5000 (0.5-1%)
- P1700 (0.5-1%)
- Printex 300 (0.5-1%)
- Lignin sulfonate (0.1-1%)

preferably usable in glyceric esters of the oleic acid:
- Lubrizol (0.1-1%)
- Solplus (0.1-1%)
- Trihexylamine (0.1-1%)
- Tris(2-ethylhexyl)amine (0.1-1%)
- Montmorillonite (0.1-2%)
- Octadecylamine (0.1-2%)
- Sol PM (0.1-1%)
- $SiO_2$, mode 7 nm (0.1-1%)
- P1700 (0.1-1%)
- Monarch 415 (0.5-1%)
- Monarch 430 (elftex) (0.5-1%)
- Printex 300 (0.5-1%)
- $SiO_2$, mode 3 microns (0.1-1%)
- Aerosil 200 (0.1-2%)
- TiOPURE (0.1-1%)
- Amorphous microsilica (0.1-1%)

preferably usable with poly-α-olefins
- Sol PM (0.1-1%)
- $TiO_2$ (0.1-2%)
- Lubrizol (0.1-1%)
- Succinimide (0.5-5%)

preferably usable with rapeseed oil
- Aerosil 200 (0.1-1%).
- TiOPURE (0.1-1%)
- Printex 300 (0.5-1%)
- Octadecylamine (0.1-2%)

A particularly preferred organic additive is trihexylamine.

A particularly preferred inorganic additive is titanium dioxide with main particle size of about 20 nm (distribution curve mode, measurement by means of laser scattering, Nanosizer instrument, Mie method).

The presence of the additive, as defined above, gives the lubricant of the invention elevated rheological stability, in other words, it prevents, or reduces sedimentation of the solid in the oil.

The stabilized lubricant composition according to the invention has the characteristics of a non-Newtonian pseudo-plastic fluid.

The term "stabilized lubricant composition" is understood to mean a solid in liquid composition, specifically the solid lubricant composition in the oil, which, on being left to rest in a container for 90 days, forms a layer of supernatant not exceeding 30% of the total height of the liquid in the container.

The term "non-Newtonian pseudo-plastic fluid", also known as a non-Newtonian thinning fluid, is understood to mean a fluid whose dynamic viscosity decreases as the shear stress increases. Such property is defined by the Shear Thinning Index, in other words, the ratio between the dynamic viscosities of a fluid measured at two different shear rates.

It has been found that the stabilized lubricant composition of the invention is characterized by the following Shear Thinning Indices:

| RVT | 0.1/1 | 1/10 | 10/100 | 100/1000 |
|---|---|---|---|---|
| STI | 3.0-7.5 | 2.0-6.5 | 1.0-3.0 | 0.5-2.0 |

wherein RVT is the ratio between two different shear rates and STI is the Shear Thinning Index corresponding to said RVT values.

Such rheological properties of the composition of the invention are determined by means of a rotational viscometer, as described in the standard procedure ASTM D2196-15 (TEST METHOD B).

It has been found that when the STI values of the lubricant composition of the invention are within the indicated ranges, it is stable with regard to sedimentation and, at the same time, it has such rheological properties as to allow the pumping thereof during use.

The stabilized lubricant composition of the invention is pumpable. A lubricant composition is defined as pumpable if it can be fed into an ingot mold with a flow from 1 ml/min to 200 ml/min, for example, by means of a dosing membrane pump.

An important characteristic of the lubricant composition of the invention is the volume fraction $\Phi$ of the solid component with respect to the liquid, which is calculated according to the expression $\Phi = C_M/\rho_P$, wherein $C_M$ is the concentration by weight of the solid component in the liquid component and $\rho_P$ is the mass density of the solid component. In the case of solid component mixtures, as in this case, the $\rho_P$ is a weighted average of the $\rho_P$ of the single components, which are reported in literature.

In preferred embodiments, the lubricant composition of the present invention has a volume fraction $\Phi$ of solid dispersed in the liquid means from 0.10 to 0.80, a density $\rho_d$ from 1.0 to 1.8 kg/L (measured according to the standard method ASTM D1298) and a relative viscosity $\eta_r = \eta/\mu_0$ from 1.25 to 10, where $\eta$ is the kinematic viscosity of dispersion at 40° C. (measured according to the standard method ASTMD445 or alternatively ASTM D2196-15) and $\mu_0$ is the kinematic viscosity of the liquid means at 40° C. (measured according to the standard method ASTMD445 or alternatively ASTM D2196-15).

The lubricant composition of the invention is produced by means of a process, comprising the following operational steps:

a) providing a lubricant powder having an average particle size from 20 to 40 microns and preferably having a melting start point of below about 600° C., preferably about 580° C.;
b) providing an oily liquid means having a kinematic viscosity, $\mu_0$ from 25 to 100 $mm^2/s$ at 40° C. (measured according to the standard method ASTMD445);
c) adding a stabilization additive to said oily liquid means;
d) dispersing said lubricant powder in said oily liquid means comprising said stabilization additive.

In one embodiment, step a) of providing the lubricant powder with the desired granulometry is carried out by grinding the granulate with hammer mills, ball mills or jet mills and/or sieving the granulate with sieves of an opportune mesh size.

In preferred embodiments, the stabilization additive is selected from those previously listed.

In one embodiment, step d) of dispersing the solid in the liquid will be carried out by adding the solid to the liquid and using a disperser having an impeller with Reynolds number≤10. For example, a disk with six blades can be used as in the Rushton turbine, a saw tooth impeller, as in the Cowles impeller, anchor impellers, propeller belt impellers or Ekato PARAVISC type (Ekato, Handbook).

In one embodiment, during the adding of the lubricant powder to the oily liquid means according to step d), the speed of the impeller is gradually brought from 80-120 rpm to 250-450 rpm or with discrete increases, then it is increased to 650-950 rpm for a period of from 45 minutes to 80 minutes.

More specifically, the oily liquid means is loaded into the disperser and mixed at low speeds, for example, about 100 rpm, then the lubricant powder is added in portions. The kinematic viscosity increases with every addition of solid, consequently the speed of the impeller is also increased, typically up to 300-400 rpm. After the last addition, the speed of the impeller is brought to 700-900 rpm for about 50 minutes. After verifying that the density and kinematic viscosity are within the ranges reported above, it is mixed at 700-900 rpm for another 10 minutes and the values of such properties, which must be constant within the precision limits of the measurement, are checked again.

Step d) can comprise a step of premixing the solid in the liquid in opportune ratios, as described above. Such premixing can be carried out, for example, in a ploughshare mixer.

In a different embodiment, the procedure of the invention is carried out in a single step, introducing a mixture of the lubricant powder and the additive in the oily liquid means into a ball mill or colloid mill, obtaining, at the same time, both the grinding of the solid and the dispersion thereof in the oily liquid means. However, the control of the solid granulometry in this embodiment is not optimal.

The solid granulometries reported in the present description can be determined using known methods, for example, comprising direct observation in the electronic microscope or assessment of the particle sizes by means of laser scattering technology using, for example, the Mastersizer 3000 instrument or Nanosizer by the company Malvern, with the Mie calculation method.

It shall be understood that the lubricant composition according to the invention can be adapted to the different needs of the process and to the different types of steel desired for production, while remaining within the limits of the parameters defined above. For example, the kinematic viscosity of the lubricant can be adapted to the particular needs of transport, of the same, to the continuous casting machine, taking into account the feeding line pressure drops, or the dispersed solid fraction can be adapted, so that, for the same volume pumped, the continuous casting machine can be fed with an opportune quantity of dispersed powder. Furthermore, the composition of the latter can be adapted, in turn, to the needs of the process, as is generally known for continuous casting powders, in particular, the basicity index can be adapted depending on whether "sticking" steels or "cracking sensitive" steels are being produced.

In a particular case of construction steel casting in square section billets 145-160 mm at a rate of 2.5-3.5 m/min, the lubricant can have the following characteristics:

Solid fraction 55-60% wt.;

Liquid base consisting of a glyceric ester of the oleic acid with a kinematic viscosity from 60 to 75 $mm^2/s$ at 40° C.;

Relative viscosity of the lubricant from 3.7 to 4.9;

Basicity index, $CaO/SiO_2$, comprised within the range 0.81±0.05;

Content of alkalis, comprised within the range 5.0-8.0% wt.;

Content of lime, comprised within the range 35.0-39.0% wt.;

Content of silica, comprised within the range 44.0-48.0% wt.;

Content of alumina, below 2.0% wt.;

Content of fluoride, $F^-$, comprised within the range 5.0-7.0% wt.;

Average particle size of the components 0.1-40 μm;

Stabilization additive 0.05%-10% in mass with respect to the oil mass.

The lubricant composition of the invention can be used in quantities from 50 to 500 g/ton of cast steel.

Experimental Part

Preparation Lubricant Composition 1

100 g of oil (poly-α-olefin) and 1 g of stabilization additive (Trihexylamine) are placed in a laboratory disperser with a saw tooth impeller. It was mixed at low speeds, after which 150 g of the lubricant powder, obtained by means of grinding the granulate with a laboratory hammer mill, was added to the disperser, according to the previously described methods. The lubricant powder mixture had the following composition:

Solid fraction 58% wt.;

Liquid base consisting of a glyceric ester of the oleic acid with a kinematic viscosity 61 $mm^2/s$ at 40° C.;

Relative viscosity of the lubricant 4.5;

Content of alkalis 5.5% wt.;

Content of lime 37.0% wt.;

Content of silica 46.0% wt.;

Content of alumina 0.81% wt.;

Content of fluoride, $F^-$, 6.5% wt.;

Average particle size of the components 37 μm;

Preparation Lubricant Composition 2

100 g of oil (triglyceric ester of the oleic acid), 1.5 g of additive (Titanium Oxide (IV), 20 nm) and 150 g of the lubricant powder mixture were placed in a high peripheral speed laboratory colloidal mill. The solids were consequently ground and dispersed in a single step. The lubricant powder mixture had the following composition:

Solid fraction 65% wt.;

Liquid base consisting of a glyceric ester of the oleic acid with a kinematic viscosity 70 $mm^2/s$ at 40° C.;

Relative viscosity of the lubricant 5.0;

Content of alkalis 6.5% wt.;

Content of lime 38.0% wt.;

Content of silica 44.0% wt.;

Content of alumina 1.2% wt.;

Content of fluoride, $F^-$, 5.5% wt.;

Average particle size of the components 42 μm;

In both cases, the product was then treated as described in point 7 of the standard procedure ASTM D2196-15, in other words:

a 0.5 L container was filled with the sample to 25 mm from the upper edge and brought to 25° C.±0.5° C.;

The container was agitated vigorously for 10 minutes and then left to rest for 60 minutes at 25° C. before the test. The test was started no sooner than 65 minutes after removing the container from the mixer.

The measurement was taken as described in point 12 of the same procedure, in other words:

the sample was kept at 25° C.;

the viscometer was regulated on the minimum rotational speed, then it was activated and the reading was taken after 10 rotations;

the rotational speed was increased in steps and the reading was taken after 10 rotations for every rotational speed of the device;

on reaching the maximum rotational speed, the operation was repeated in the opposite direction, again reading the value after 10 rotations for every regulated decreasing rotational speed, until the minimum speed;

the rotation was interrupted and the sample was left to rest for 1 minute;

the device was activated again on the minimum rotational speed and the value reading was taken after 10 rotations.

The analysis was carried out using an Anton Paar MCR 302 rheometer provided with a coaxial cylinder geometry.

It is thus possible to describe the behavior of a lubricant composition, creating the characteristic curve thereof from the viscosity values measured at different shear rates. This curve, called a "viscosity curve", effectively represents the behavior of the fluid at different sliding speeds, highlighting the non-Newtonian nature thereof. A typical example of a viscosity curve for a lubricant composition is reported in FIG. 1, where, with respect to what is described in point 12 of the procedure ASTM, only the viscosity values measured during the shear rate rising slope are represented, since they are of greater interest.

In particular, it can be observed that for the continuous casting lubricant compositions of the invention, the dynamic viscosity passes from a value in the order of dozens of Pa·s (at 0.1 $s^{-1}$) to values also below the unit (at 1000 $s^{-1}$).

Table 1 shows the results of the analyses carried out on compositions 1 and 2, with the relative Shear Thinning Index data:

| Lubricant | Viscosity (Pa · s) | | | | | Shear Thinning Index | | | |
|---|---|---|---|---|---|---|---|---|---|
| Composition | 0.1 ($s^{-1}$) | 1 ($s^{-1}$) | 10 ($s^{-1}$) | 100 ($s^{-1}$) | 1000 ($s^{-1}$) | 0.1/1 | 1/10 | 10/100 | 100/1000 |
| 1 | 28.3 | 4.5 | 1.3 | 0.79 | 0.71 | 6.3 | 3.6 | 1.6 | 1.1 |
| 2 | 70.3 | 14.4 | 2.6 | 1.3 | 1.0 | 4.9 | 5.5 | 2.0 | 1.2 |

The stability measurement of the lubricant compositions described herein was taken by collecting a sample of product in a plastic cylindrical test tube (dimensions: Ø=43 mm, h=103 mm) with a screw cap. The tube was left immersed in a thermostatically-controlled water bath at 40° C. The height of the gradually formed supernatant was periodically measured using an electronic reading gauge (±0.01 mm).

Both composition 1 and composition 2 proved stable on sedimentation.

The pumpability of compositions 1 and 2 was also checked by means of a membrane dosing pump IWAKI model EH-E31VC-20EPE5. Both compositions were pumpable.

The use of the lubricant composition of the invention allowed significant advantages to be obtained in processes of continuous open and close casting, for example, elimination of diamonds and the consequent elimination of cracks at the edges, increased performance due to a significant reduction in the formation of flakes (a 30-70% reduction by weight of flakes) and a reduction in the formation of cracks in general.

A further important advantage is the option of increasing the casting speed after suitably regulating the primary and secondary cooling water flows.

The use of the lubricant composition of the invention also allows poor quality scrap to be utilized as a source of steel, making steel casting possible in these conditions.

The stabilized lubricant composition of the invention also overcomes the technical problem of stability on sedimentation and pumpability during the use phase.

In conclusion, the lubricant composition of the invention offers the advantages typical of oils, in other words, convenient storage, easy manageability, it does not create powder during the use thereof, reduced vulnerability to humidity, prolonged shelf-life, but without sacrificing the standards of quality typically obtainable with powders for an ingot mold. A further advantage is improved compatibility with the environment compared to the known lubricant compositions.

The invention claimed is:

1. A lubricant composition for processes for producing steel by continuous casting, the lubricant composition comprising a dispersion of a lubricant powder for an ingot mold in continuous casting, in an oily liquid means, and a stabilization additive, wherein the lubricant composition has the following shear thinning index values:

| RVT | 0.1/1 | 1/10 | 10/100 | 100/1000 |
|---|---|---|---|---|
| STI | 3.0-7.5 | 2.0-6.5 | 1.0-3.0 | 0.5-2.0 |

wherein RVT is the ratio between two different shear speeds and STI is the shear thinning index corresponding to said RVT values, wherein the stabilization additive is selected from:

secondary or tertiary amines with C4-C18 chains;

amides or imides with C4-C18 chains;

esters of mono- or di- carboxylic acids with C4-C18 chains with alcohols or polyols with C4-C18 chains;

mono- or poly-carboxylic acids with C4-C18 chains;

Salts of one or more of the aforesaid compounds; and amino acids and peptides up to 10 amino acidic units.

2. The lubricant composition according to claim 1, wherein the stabilization additive is selected from trihexylamine and titanium dioxide with a main particle size of about 20 nm.

3. The lubricant composition according to claim 1, wherein the stabilization additive is used in a concentration from 0.05% to 10% in mass with respect to the oil mass.

4. The lubricant composition according to claim 1, wherein the oily liquid means is selected from or comprises glyceric esters of fatty acids and/or poly-α-olefins.

5. The lubricant composition according to claim 1, wherein the oily liquid means has a kinematic viscosity, $\mu_0$, from 25 to 150 $mm^2/s$ at 40° C. (ASTM D445, gravimetric method with capillary viscometer) and a pour point ≤−20° C., measured according to the standard method ASTM D-97.

6. The lubricant composition according to claim 1, wherein the lubricant powder has a melting start point at less than about 600° C.

7. The lubricant composition according to claim 1, wherein the lubricant powder comprises carbon in the form of graphite, ground coke or carbon black, $SiO_2$, $Al_2O_3$, $Na_2O$, CaO, fluorides, oxides of transition metals and one or more of $TiO_2$, $B_2O_3$, and/or $La_2O_3$, and wherein the lubricant powder has the following characteristics:

Basicity index, $CaO/SiO_2$, comprised within the range 0.25-1.8;

Content of alkalis, comprised within the range 0.1-15.0% wt.;

Content of alkaline earth metals, comprised within the range 0.1-45.0% wt.;

Content of alumina, comprised within the range 0.1-25.0% wt.;

Content of MnO, $MnO_2$, and $Fe_2O_3$, comprised within the range 0.1-15.0% wt.;

Content of fluoride, F−, comprised within the range 0.1-14.0% wt.;

Content of $TiO_2$, $B_2O_3$, and/or $La_2O_3$, comprised within the range 0.1-15.0% wt; and Average particle size of the components 0.1-100 μm, measured according to the standard method ASTM D4464-10.

8. The lubricant composition according to claim 1, wherein the lubricant composition has a volume fraction $\phi$ of solid dispersed in the liquid means from 0.10 to 0.80, a density $\rho_d$ from 1.0 to 1.8 kg/L (measured according to the standard method ASTM D1298), and a relative viscosity $\eta_r=\eta/\mu_0$ from 1.25 to 10 where $\eta$ is the kinematic viscosity of the dispersion at 40° C. (measured according to the standard method ASTMD445 or alternatively ASTM D2196-15) and $\mu_0$ is the kinematic viscosity of the liquid means at 40° C. (measured according to the standard method ASTM D445 or alternatively ASTM D2196-15).

9. A process for preparing the lubricant composition according to claim 1, the process comprising:

a) providing a lubricant powder having an average particle size from 20 to 40 microns;

b) providing an oily liquid means having a kinematic viscosity, $\mu_0$, from 25 to 100 $mm^2/s$ at 40° C. (measured according to the standard method ASTMD445);

c) adding a stabilization additive to said oily liquid means; and d) dispersing said lubricant powder in said oily liquid means comprising said stabilization additive.

10. The process according to claim 9, wherein said process is carried out in a single step comprising introducing a mixture of the lubricant powder and stabilization additive to the oily liquid means in a ball mill or colloid mill and obtaining, at the same time, both the grinding of the solid and the dispersion thereof in the liquid means.

11. A procedure for continuous casting of steel, the procedure comprising adding a stabilized lubricant composition according to claim 1, wherein said lubricant composition is used in quantities from 50 to 500 g/ton of cast steel.

12. The lubricant composition according to claim 4, wherein the oily liquid means is selected from or comprises a glyceric or triglyceric ester of oleic acid and/or poly-α-olefins.

13. The lubricant composition according to claim 6, wherein the lubricant powder has a melting start point at about 580° C.

14. The process according to claim 9, wherein the lubricant powder has a melting start point of less than about 600° C.

15. The process according to claim 14, wherein the lubricant powder has a melting start point of about 580° C.

* * * * *